United States Patent [19]

Bachman

[11] 4,142,079

[45] Feb. 27, 1979

[54] FLOAT-LEVEL SWITCH WITH LIFTING MECHANISM

[75] Inventor: Albert J. Bachman, Bristol, Conn.

[73] Assignee: DeLaval Turbine Inc., Princeton, N.J.

[21] Appl. No.: 876,314

[22] Filed: Feb. 9, 1978

[51] Int. Cl.[2] ..... H01H 35/18

[52] U.S. Cl. ..... 200/84 C; 73/313; 340/624; 335/207

[58] Field of Search ..... 200/61.2, 84 R, 84 C; 335/207, 306; 73/308, 311, 313, 314, DIG. 5; 340/623, 624

[56] References Cited

U.S. PATENT DOCUMENTS

| | | | |
|---|---|---|---|
| 3,815,416 | 6/1974 | Portis | 340/624 |
| 3,947,813 | 3/1976 | Vemura | 200/84 C |
| 3,982,087 | 9/1976 | Bachman | 200/84 C |

*Primary Examiner*—Gerald P. Tolin

*Attorney, Agent, or Firm*—Hopgood, Calimafde, Kalil, Blaustein & Lieberman

[57] ABSTRACT

The invention contemplates remotely operable lifting mechanism for selectively displacing a liquid-level float in a sealed tank, to permit checking of the operational status of the float throughout its displaceable range, and to permit check-out of magnetically operated electrical means actuated by the float at a predetermined float level within its displaceable range. The lifting force is coupled magnetically to the float without interference with the path of float movement and without interference with the magnetically operated electrical means.

22 Claims, 7 Drawing Figures

FLOAT-LEVEL SWITCH WITH LIFTING MECHANISM

This invention relates to a float-operated liquid-level switch and in particular to means for checking-out the operational status thereof without interfering with normal float-operated functioning of the switch. The invention is applicable to and will be described in connection with such switches of the multiple-level variety, i.e., wherein float response to liquid level is monitored at each of a plurality of predetermined levels within a particular tank, such as an oil bunker in a navigable vessel.

In one variety of such multi-level switches, a single fixed vertical tubular housing of non-magnetic material extends down into a tank and serves to guide each of a plurality of annular magnet-bearing floats, each float being limited by housing stops to cover a short range of vertical displacement which straddles the particular liquid level it is to monitor. Within the housing, separate magnetic-reed switches are fixed at each of the particular monitored levels, for response to the field of the nearby magnet-equipped float as the latter rises to or descends from the particular level. Such float-operated switches amply meet many requirements, but in a sealed-tank system there has been no means of access to actuate the float or floats for an operational check-out without the laborious task of filling and emptying the tank.

It is, accordingly, an object of the invention to provide improved float-operated switch structure of the character indicated.

Another object is to provide for ready check-out of the operational status of such structure from a location external to the tank within which one or more particular liquid levels are to be monitored.

It is also an object to meet the above objects in application to a sealed tank containing the float-operated structure.

A still further object is to meet the above objects without mechanically contacting the float or floats and without interfering with the normal liquid-level response action of the float or floats.

A specific object is to provide relatively simple mechanism to permit an operator, prior to filling a tank, to check that the float or floats are movable throughout their displacement ranges, and to ascertain that electrical switching means associated with all floats are functional, for their alarm-circuit or other wired purposes.

Other objects and various further features of novelty and invention will be pointed out or will occur to those skilled in the art from a reading of the following specification, in conjunction with the accompanying drawing. In said drawings, which show, for illustrative purposes only, a preferred form of the invention:

Figure 1:
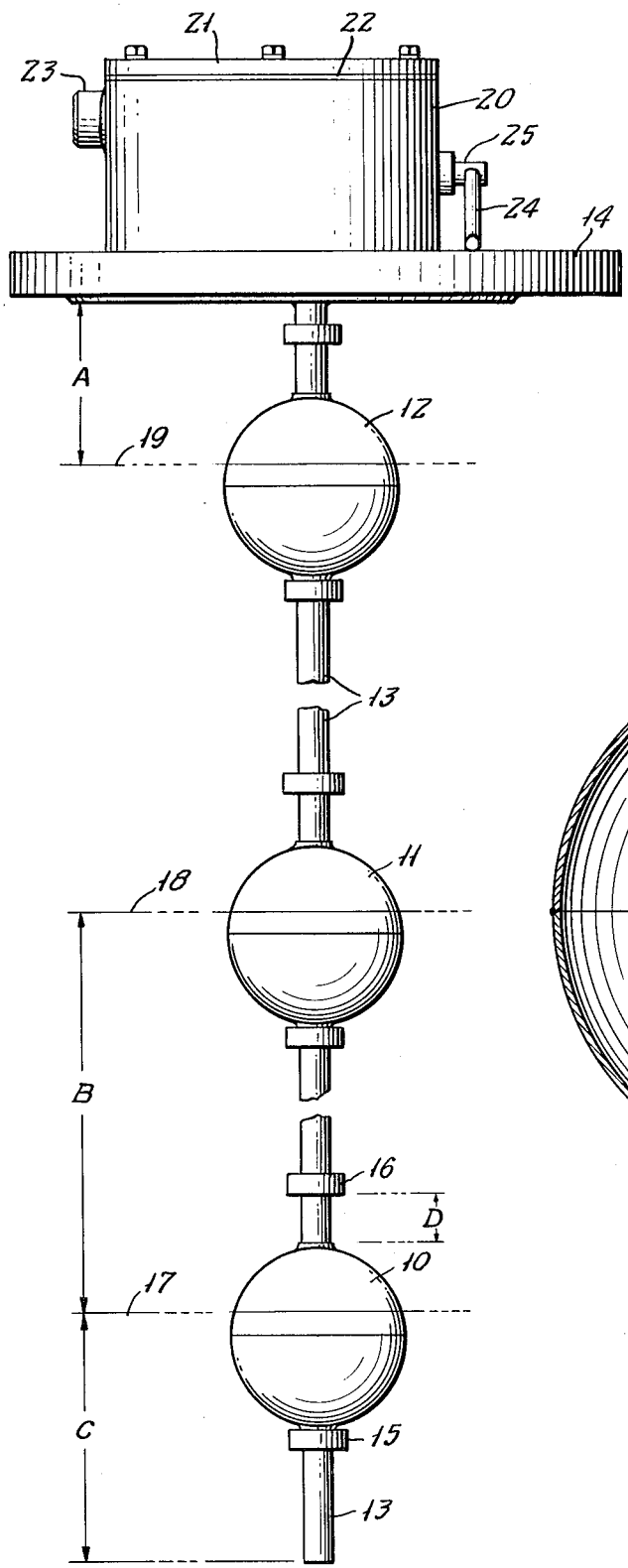
FIG. 1 is a simplified view in side elevation of multi-level, float-operated switch structure equipped with operational check-out means of the invention.

Referring initially to FIG. 1, the invention is shown in application to a float-operated electric-switch level-indicating system comprising plural like annular floats 10-11-12 surrounding and guided by a fixed tubular housing 13. The lower end of housing 13 is closed, and the upper end is characterized by a mounting flange 14. In installed orientation, flange 14 is bolted to seal the closure of a circular opening atop a tank (not shown), such as an oil bunker in a navigable vessel, the housing 13 with its floats 10-11-12 being suspended vertically beneath flange 14 and within the storage volume of the tank. Each float, such as the lower float 10, is limited by lower and upper collars 15–16 clamped to housing 13, so as to determine a relatively short range D of vertical displaceability. The range D straddles the particular liquid level at which the electric switch associated with each float is predetermined to be operative; thus, float 10 may monitor for an almost-empty tank wherein the associated switch action occurs when the center of float 10 achieves the level 17, and floats 11 and 12 perform similarly at intermediate and upper liquid levels 18–19, respectively.

Figure 3:
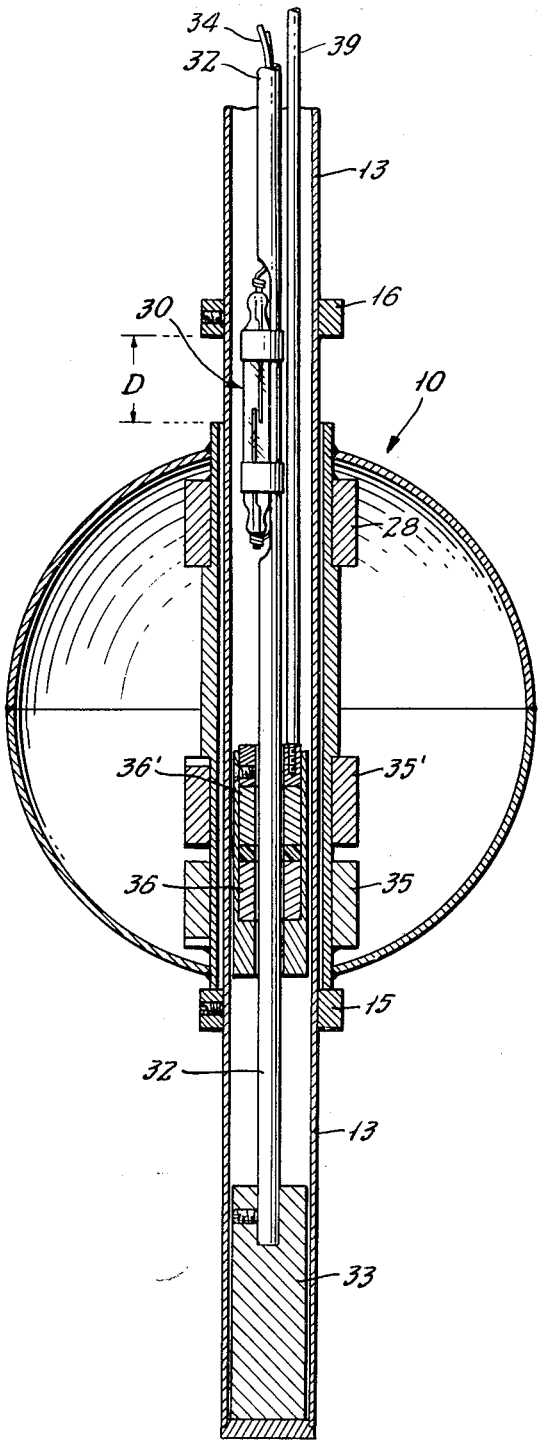
Figure 4:
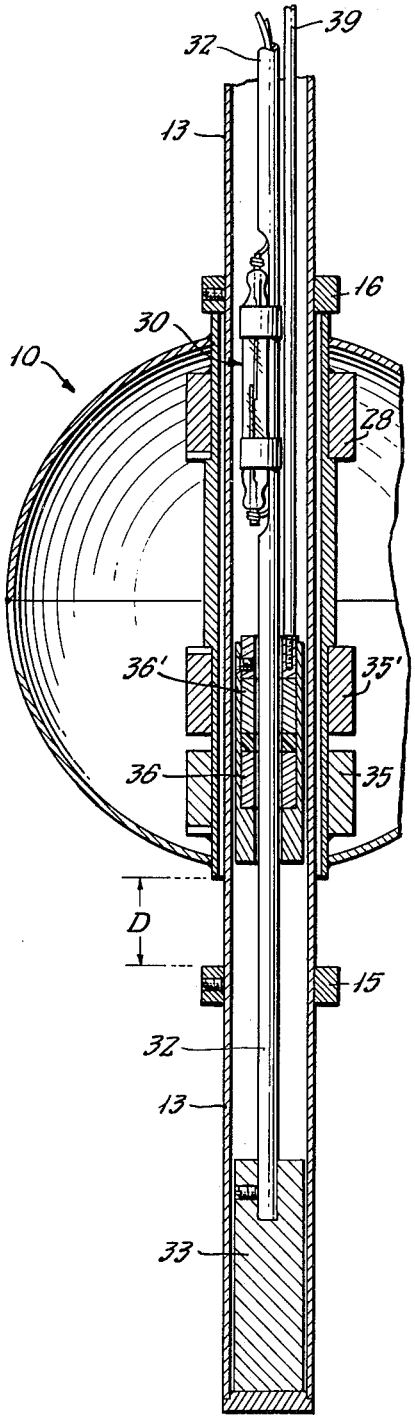

The electric-switch action and other internal functions associated with floats 10-11-12 will be described in detail in connection with FIGS. 2, 3 and 4, but it suffices in the description of FIG. 1 to state that these switches and the lead wiring to serve them are contained within housing 13 and are available for external-circuit connection within a cylindrical enclosure 20 having a removable cover 21 and forming part of the flange portion 14 of housing 13; a sealing gasket 22 serves the clamped condition of cover 21. A conduit port 23 is shown at one side of enclosure 20 for sealed electric-cable connection to the float-switch wiring, and an externally accessible handcrank 24 on a rotary shaft 25 is the means of actuating the floats 10-11-12 for the purposes of the invention.

Figure 2:
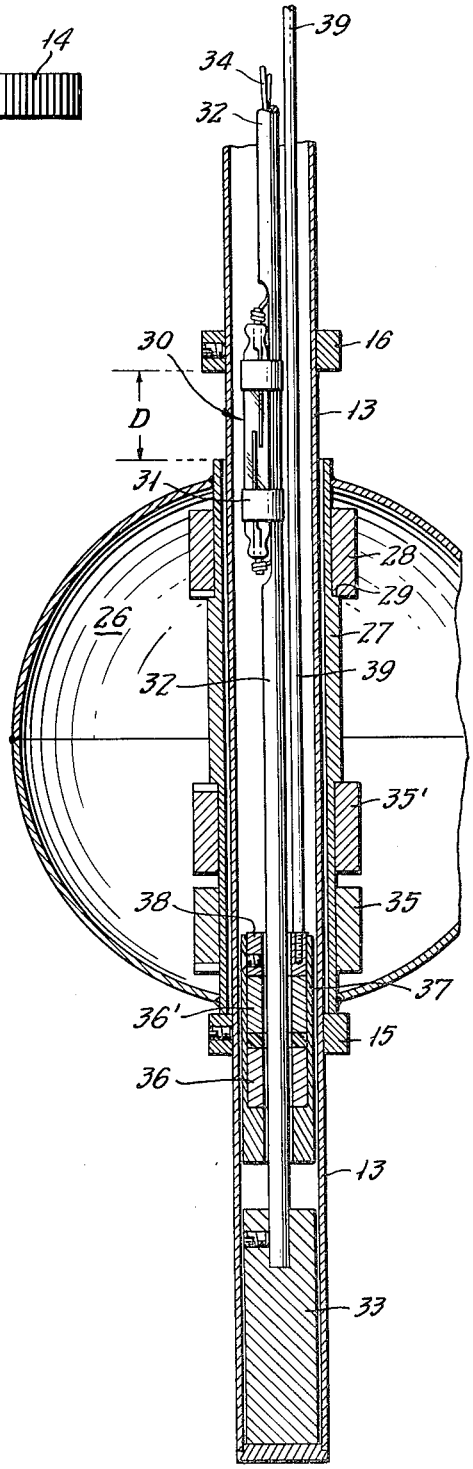
FIGS. 2, 3 and 4 are enlarged fragmentary sectional views at and near the lowermost float of FIG. 1, respectively taken to illustrate three different relations of co-operating parts.

FIG. 2 provides representative detail for description of the level-responsive and check-out elements associated with each float, the lowermost float 10 and its associated magnetic and electric components being shown near the closed end of housing 13 and for the empty condition of the tank, wherein float 10 rests upon its lower stop collar 15. Float 10 is shown to comprise a spherical outer shell 26 and a tubular inner shell 27 diametrically connecting upper and lower ends of the shell 26. Inner shell 27 has vertically guided running clearance with housing 13, and the parts 26, 27 and 13 are of non-magnetic material, such as aluminum or a suitably rigid plastic. An annular permanent magnet 28 is seated against a shoulder 29 near the upper end of tubular shell 27; the magnet 28 serves to actuate an associated electrical switch 30, shown as of the magnetic-reed hermetically sealed variety and fixedly mounted within housing 13. It will be understood that switch 30 is operated (e.g., to close its normally open contacts) when float 10 has risen approximately one half its collar-limited travel distance D, i.e., when float 10 reaches the level 17, and that, upon descent below this level, switch 30 will be returned to its normal unactuated condition. Switch 30 is shown fixed as by adhesive tape 31 to a central tube 32 within housing 13, and the lower end of tube 32 is fixed to a centering plug 33 which rests on the closed bottom of the housing 13; lead wiring 34 to switch 30 is carried within the central tube 32.

In accordance with the invention, the externally operable means 24 is operative to cause the selective nonbuoyant displacement of float 10, throughout its travel distance D, using a releasable magnetic coupling between float 10 and a movable means within housing 13. The float-borne half of this coupling is shown as two closely spaced annular permanent magnets 35-35' fixedly mounted to the inner shell 27, and near the lower end thereof; the movable half of the coupling comprises two annular magnets 36-36' which are similarly spaced and contained within the counterbore of a tubular shell 37 of non-magnetic material. The upper end of shell 37 is secured to an annulus 38 of non-magnetic material, and an off-center lift rod 39 provides a directly linked lifting connection between annulus 38 and the actuating handcrank 24. In its lower position, handcrank 24 rests upon flange 14 and thus provides a bottom-limiting position stop for the movable-magnet assembly 36-36'-37-38; in the thus-limited bottom position (shown in FIG. 2), the movable-magnet assembly will be understood to be effectively out of the range of coaction with the float-borne lifting magnets 35-35', and it will be further understood that all lifting magnets 35-35'-36-36' are at all times sufficiently remote from switch 39 and its actuating magnet 28 to have no effect upon switch operation. Upon a lifting actuation of handcrank 24 and rod 39, the movable magnetic means 36-36' is first raised to a position of magnetically latched relation to the float-borne lifting magnets, as shown in FIG. 3; thereafter, upon further lifting actuation of handcrank 24, float 10 is bodily liftable, to the maximum extent D and, therefore, through the elevation at which switch 30 is actuated by the proximity of the switch-operating magnet 28. Upon descent of the handcrank 24, switch 30 is first returned to its normal unactuated condition; and, upon float interception by the bottom stop 15, a downwardly directed thrust by lift rod 39 will be needed to disengage the magnetically latched relation and to return the parts to their FIG. 2 relationship, for normal (buoyant) float-actuated switch operation. Preferably, a preloaded biasing spring 40 (FIGS. 5 and 6), within the sealed enclosure 20, provides the necessary latch-releasing thrust via rod 39.

Figure 5:
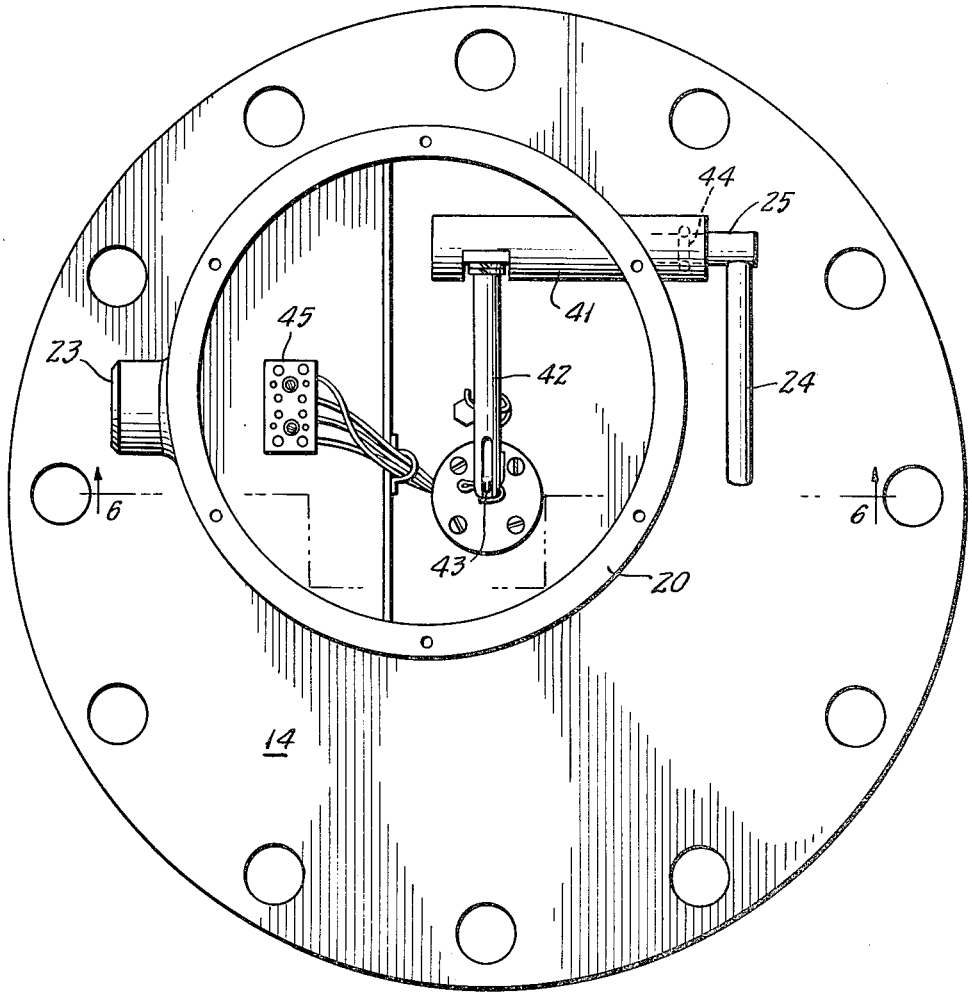
FIGS. 5 and 6 are respectively plan and side-elevation views of externally accessible actuating mechanism for the check-out means of the invention, part of FIG. 6 being broken-away and in section at 6—6 of FIG. 5.
Figure 6:
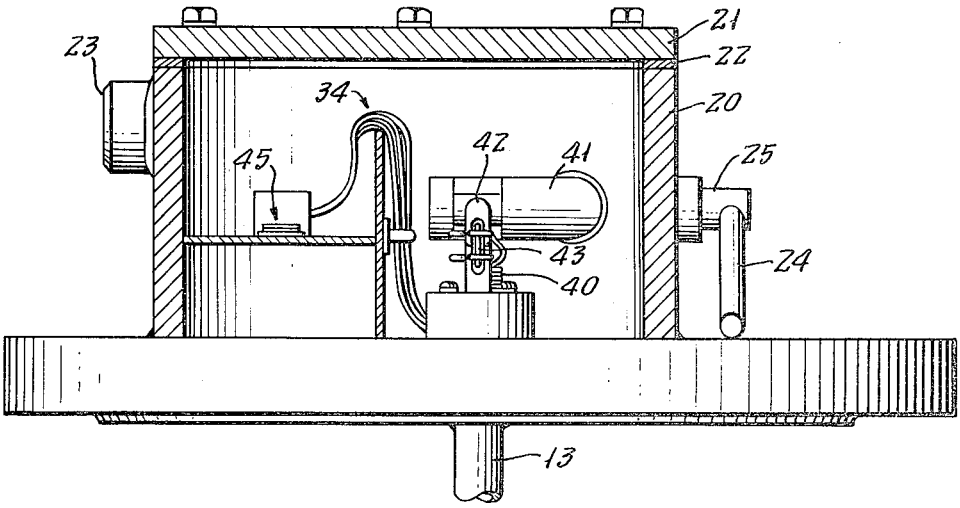

In FIGS. 5 and 6, the shaft 25 for handcrank 24 is seen to be journaled in an elongate bearing 41 extending through the wall of enclosure 20. Within enclosure 20, a further crank arm 42 on shaft 25 is link-connected at 43 to the lift rod 39, and of course spring 40 normally holds rod 39 to its lowermost position, limited by handcrank 24 in contact with flange 14. Suitable seal means, such as one or more O-rings 44, seal the enclosure 20 at the shaft and journal passage, and external cabling or conduit (not shown) will be understood to complete the seal at port 23, a terminal board being shown at 45 for the electrical leads to switch 30 (and to corresponding switches at levels 17-18-19).

Figure 7:
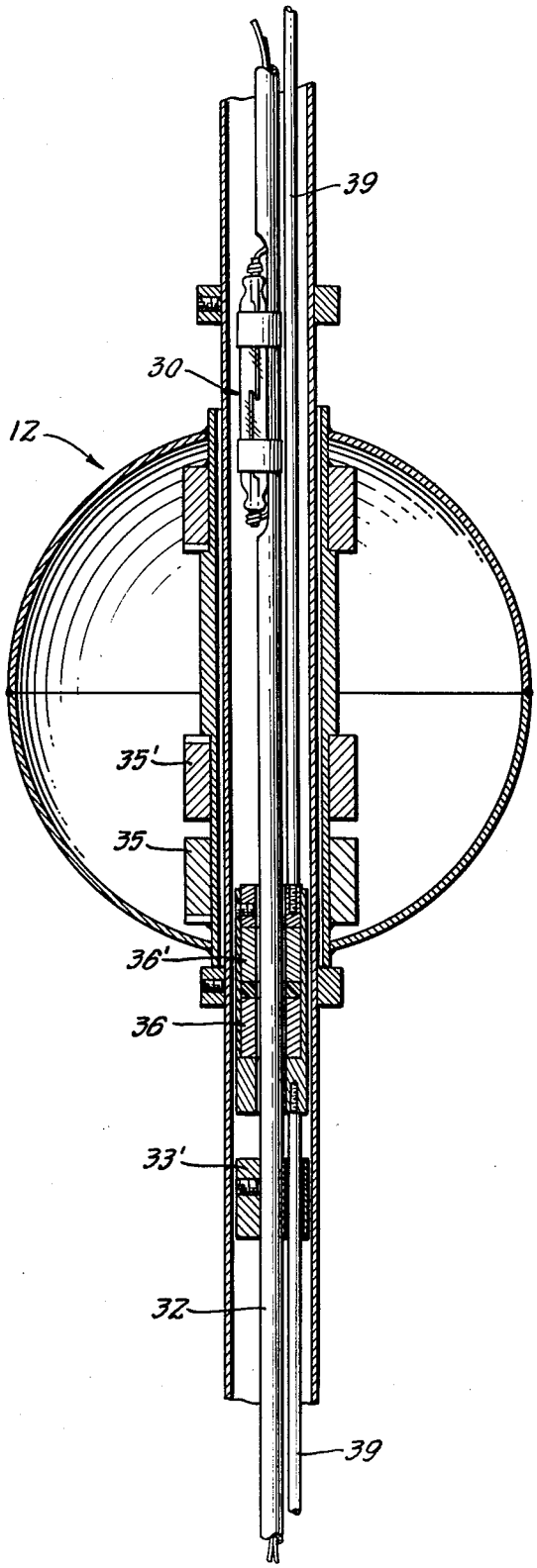
FIG. 7 is a view similar to FIG. 2, to illustrate the uppermost float of FIG. 1.

FIG. 7 will be recognized for its similarity to FIG. 2, to illustrate continuity or effective continuity of the lift rod 39 and of the central tube 32. These parts are shown for the case of the uppermost float 12 and will be understood to be precisely the same at the float 11 location. Importantly, the central tube 32 remains rigid and fixed with respect to housing 13, and the lift rod 39 is effectively continuous and rigid for its full vertical effective extent.

Centering plugs, as at 33', provide correct positioning of central tube 32 at various spaced locations, assuring annular clearances for easy lifting-magnet displacement.

It will be seen that the described multiple-level float-switch system with selectively operable float-lifting mechanism, is applicable to a float-level system of one or any number of floats, each monitoring a tank for different particular liquid-level conditions. One actuation of handcrank 24 elevates all floats, thereby causing all switches 30 to operate and certifying as to the operational acceptability of the system, as a condition precedent to a refilling of the tank. The check-out which is possible with the invention is performed without any mechanical connection to or interference with the normal buoyant operation of all floats, and even though magnetic means serve both switch-actuating and float-lifting functions, these functions are totally independent of each other and switch operation thus cannot be impaired.

It will be appreciated that various polarizing patterns may characterize the magnets 35-35'-36-36' to achieve the desired magnetically latching relation. For example, all these magnets may be radially polarized, with axially adjacent corresponding magnets oppositely polarized. Thus, with float magnet 35 radially polarized with N inside and S outside, the adjacent float magnet 35' may be oppositely polarized, namely, with N outside and S inside; in that event, the movable magnet 36 should be radially polarized N inside and S outside, while the adjacent movable magnet 36' is radially polarized with N outside and S inside. With such relation of float-borne and movable lifting magnets, the first and only strong latching action will be achieved when the N pole of magnet 36' and the S pole of magnet 36 are in maximum overlapping coaxial register with their oppositely poled counterparts 35-35' on the float.

While the invention has been described in detail for the preferred form shown, it will be understood that modifications may be made without departing from the scope of the invention.

What is claimed is:

1. In a magnetically operative float-type liquid-level switch, comprising an elongate non-magnetic tubular housing adapted for fixed vertical mounting within a tank for which a particular liquid level is to be monitored, an annular float surrounding and guided for buoyant vertical movement along a portion of said housing, a magnetic-reed electric switch fixedly positioned within said housing at a location correlated with the liquid level to be monitored, externally accessible electric-circuit means including a lead-connection to said switch within said housing, a switch-operating permanent magnet fixed to said float and operative to actuate said switch upon said float achieving said particular level and to release the actuation of said switch upon float descent below said particular level, the improvement which comprises additional permanent-magnet means fixedly carried by said float in axially spaced relation to said switch-operating magnet, a fixed float stop carried by said housing and positioned to prevent float descent beyond a predetermined lower limit of float motion, said lower limit being below said particular level, a vertically movable magnet within said housing and operative when in elevational proximity to said additional permanent-magnet means to develop a magnetically latching relation thereto, and elongate selectively operable lifting mechanism connected to said movable magnet and extending within and to the upper end of said housing; whereby upon actuating said lifting mechanism to raise said movable magnet into operative relation with said additional permanent-magnet means, said lifting mechanism is operative to also raise said float from its lower-limit position and through an operational check-out range of float displacement to and through said particular level.

2. The improvement of claim 1, in which that part of said lifting mechanism which extends within said housing and is connected to said movable magnet is a longitudinally rigid rod, whereby upon lifted actuation of said movable magnet into magnetically latched relation to said float via said additional permanent-magnet means, the magnetically latched relation may be released by a depressing displacement of said rod once said float is in its lower-limit position.

3. The improvement of claim 2, in which said lifting mechanism includes an externally accessible actuator operative connected to said rod.

4. The improvement of claim 3, in which said lifting mechanism includes preloaded spring means biased in the direction of disengaging said magnetically latching relation.

5. The improvement of claim 4, in which said housing includes an upper mounting flange for removable fixed mounting at a tank opening, said flange having an opening for motional accommodation of said rod, said actuator being carried by said flange and being connected to said rod externally of said housing.

6.The improvement of claim 5, in which said flange includes sealable housing structure surrounding the actuator connection to said rod.

7. The improvement of claim 6, in which said spring means is contained within said sealable housing.

8. The improvement of claim 6, in which said electric-circuit means includes terminal-connection means within said sealable housing and for the lead connections to said switch.

9. The improvement of claim 1, in which that part of said lifting mechanism which extends within said housing and is connected to said movable magnet has a positive-displacement actuating relation to said movable magnet in both the lift-actuating direction and the descent-actuating direction, whereby a magnetically latching engagement may be disengaged by a descent-actuating operation of said lifting mechanism once said float is in its lower-limit position.

10. The improvement of claim 1, in which said float is one of two spaced like floats movably guided by said tubular housing and for monitoring different liquid levels within the tank, a fixed float stop carried by said housing and positioned to prevent descent of the second float beyond a predetermined lower limit of second-float motion, said last-mentioned lower limit being below the particular liquid level to be monitored by said second float, said lifting mechanism having similar connection to the movable magnets locally associated with the respective floats.

11. The improvement of claim 1, in which said float is the upper one of a plurality of like vertically spaced floats movably guided by said tubular housing and for monitoring different liquid levels within the tank, a first fixed float stop carried by said housing and positioned to prevent descent of a lower float beyond a predetermined lower limit of lower-float motion, a second fixed float stop carried by said housing and positioned to prevent ascent of said lower float beyond a predetermined upper limit of lower-float motion, said last-mentioned lower and upper limits being respectively below and above the particular liquid level to be monitored by said lower float, and said lifting mechanism including a rigid connection between the movable magnets locally associated with the respective floats.

12. The improvement of claim 11, in which said plurality is two.

13. The improvement of claim 11, in which said plurality is three, one of said floats and its associated upper and lower stops being positioned to monitor an upper limiting liquid level in the tank and the lowermost of said floats and its associated upper and lower stops being positioned to monitor a lower limiting liquid level in the tank.

14. The improvement of claim 1, in which stop means longitudinally fixed within said housing is positioned to retain said movable magnet at a location below the elevation of said magnetically latching relation.

15. The improvement of claim 1, in which said float comprises a generally spherical outer shell and a non-magnetic tubular inner shell extending diametrically between upper and lower ends of said float and having verticaly guided relation to said housing.

16. The improvement of claim 15, in which said switch-operating magnet is annular and is mounted near the upper end of said tubular inner shell.

17. The improvement of claim 15, in which said additional permanent-magnet means is annular and is mounted near the lower end of said tubular inner shell.

18. The improvement of claim 17, in which said additional permanent-magnet means comprises two axially spaced annular magnets having greater spacing from said switch-operating magnet than from each other.

19. The improvement of claim 18, in which said vertically movable magnet is one of two like magnets having essentially the same relation of axial spacing from each other as is the spacing between the axially spaced magnets of said additional permanent-magnet means.

20. The improvement of claim 1, in which the means of fixing the position of said switch is an elongate fixed central rod within said housing, said switch being assembled to said rod at one longitudinal location, and said movable magnet being annular and movably guided in the annular space between said central rod and said housing.

21. The improvement of claim 20, in which a collar is fixedly positioned on said central rod to determine a lower-limit stop for movement of said movable magnet, being at an elevation below the elevation of said magnetically latching relation.

22. The improvement of claim 20, in which said tubular housing has a closed bottom end, and means within said housing and abutting said bottom end and providing a fixed positional elevation of said central rod with respect to said housing.

* * * * *